US005291733A

United States Patent [19]

Halila

[11] Patent Number: 5,291,733

[45] Date of Patent: Mar. 8, 1994

[54] LINER MOUNTING ASSEMBLY

[75] Inventor: Ely E. Halila, Cincinnati, Ohio

[73] Assignee: General Electric Company, Cincinnati, Ohio

[21] Appl. No.: 14,923

[22] Filed: Feb. 8, 1993

[51] Int. Cl.[5] ..... F02C 7/20

[52] U.S. Cl. ..... 60/39.31; 60/39.32; 60/752; 60/753

[58] Field of Search ..... 60/39.31, 39.32, 747, 60/752, 753; 431/154, 350

[56] References Cited

U.S. PATENT DOCUMENTS

| | | | |
|---|---|---|---|
| 3,918,255 | 11/1975 | Holden | 60/753 |
| 3,972,182 | 8/1976 | Salvi | 60/39.32 |
| 4,173,118 | 11/1979 | Kawaguchi | 60/39.65 |
| 4,180,972 | 1/1980 | Herman et al. | 60/39.32 |
| 4,194,358 | 3/1980 | Stenger | 60/39.06 |
| 4,322,945 | 4/1982 | Peterson et al. | 60/39.32 |
| 4,374,466 | 2/1983 | Sotheran | 60/39.36 |
| 4,512,159 | 4/1985 | Memmen | 60/752 |
| 4,567,730 | 2/1986 | Scott | 60/757 |
| 5,055,032 | 10/1991 | Altemark et al. | 431/154 |

OTHER PUBLICATIONS

Jones, "Advanced Technology for Reducing Aircraft Engine Pollution," Nov. 1974, Transactions of the ASME, Serie B: Journal of Engineering for Industry, pp.: 1354–1360.

*Primary Examiner*—Richard A. Bertsch
*Assistant Examiner*—Howard R. Richman
*Attorney, Agent, or Firm*—Jerome C. Squillaro; Charles L. Moore, Jr.

[57] ABSTRACT

A mounting assembly includes an annular supporting flange disposed coaxially about a centerline axis which has a plurality of circumferentially spaced apart supporting holes therethrough. An annular liner is disposed coaxially with the supporting flange and includes a plurality of circumferentially spaced apart mounting holes aligned with respective ones of the supporting holes. Each of a plurality of mounting pins includes a proximal end fixedly joined to the supporting flange through a respective one of the supporting holes, and a distal end disposed through a respective one of the liner mounting holes for supporting the liner to the supporting flange while unrestrained differential thermal movement of the liner relative to the supporting flange.

10 Claims, 4 Drawing Sheets

LINER MOUNTING ASSEMBLY

The invention herein described was made in the performance of work under a NASA contract and is subject to the provisions of section 305 of the National Aeronautics and Space Act of 1958, Public Law 85-568 (72 Stat. 435; 42 USC 2457).

The present invention relates generally to gas turbine engines, and, more specifically, to a low $NO_x$ combustor therein.

CROSS REFERENCE TO RELATED APPLICATION

The present invention is related to concurrently filed patent applications Ser. No. 08/014/949, entitled "Segmented Combustor, " Ser. No. 08/014/886, entitled "Combustor Liner Support Assembly, " and Ser. No. 08/014,887, entitled "Low $NO_x$ Combustor," all by the same inventor and assignee.

BACKGROUND OF THE INVENTION

In a gas turbine engine, a fuel and air mixture is ignited for generating combustion gases from which energy is extracted for producing power, such as thrust for powering an aircraft in flight. In one aircraft designated High Speed Civil Transport (HSCT), the engine is being designed for powering the aircraft at high Mach speeds and high altitude conditions. And, reduction of exhaust emissions from the combustion gases is a primary objective for this engine.

More specifically, conventionally known oxides of nitrogen, i.e. $NO_x$, are environmentally undesirable and the reduction thereof from aircraft gas turbine engines is desired. It is known that $NO_x$ emissions increase when cooling air is injected into the combustion gases during operation. However, it is difficult to reduce the amount of cooling air used in a combustor since the combustor itself is typically made of metals requiring suitable cooling in order to withstand the high temperatures of the combustion gases.

In a typical gas turbine engine, a compressor provides compressed air which is mixed with fuel in the combustor and ignited for generating combustion gases which are discharged into a conventional turbine which extracts energy therefrom for powering, among other things, the compressor, In order to cool the combustor, a portion of the air compressed in the compressor is bled therefrom and suitably channeled to the various parts of the combustor for providing various types of cooling thereof including conventionally film cooling and impingement cooling. However, any air bled from the compressor which is not used in the combustion process itself decreases the overall efficiency of the engine, but, nevertheless, is typically required in order to suitably cool the combustor for obtaining a useful life thereof.

One conventionally known, advanced combustor design utilizes the non-metallic combustor liners which have a higher heat temperature capability than the conventional metals typically utilized in a combustor. Non-metallic combustor liners may be conventionally made from conventional Ceramic Matrix Composite (CMC) materials such as that designated Nicalon/Silicon Carbide (SiC) available from Dupont SEP, and conventional carbon/carbon (C/C) which are carbon fibers in a carbon matrix being developed for use in high temperature gas turbine environments. However, these non-metallic materials typically have thermal coefficients of expansion which are substantially less than the thermal coefficients of expansion of conventional superalloy metals typically used in a combustor from which such non-metallic liners must be supported.

Accordingly, during the thermal cycle operation inherent in a gas turbine engine, the various components of the combustor expand and contract in response to heating by the combustion gases, which expansion and contraction must be suitably accommodated without interference in order to avoid unacceptable thermally induced radial interference loads between the combustor components which might damage the components or result in an unacceptably short useful life thereof. Since the non-metallic materials are also typically relatively brittle compared to conventional combustor metallic materials, they have little or no ability to deform without breakage. Accordingly, special arrangements must be developed for suitably mounting non-metallic materials in a conventional combustor in order to prevent damage thereto from radial interference during thermal cycles and for obtaining a useful life thereof.

Since non-metallic materials being considered for use in a combustor have higher temperature capability than conventional combustor metals, they may be substantially imperforate without using typical film cooling holes therethrough, which therefore reduces the need for bleeding compressor cooling air, with the eliminated film cooling air then reducing $NO_x$ emissions since such air is no longer injected into the combustion gases downstream from the introduction of the original fuel/air mixture. However, it is nevertheless desirable to cool the back sides of the non-metallic materials in the combustor, with a need, therefore, for discharging the spent cooling air into the flowpath without increasing $NO_x$ emissions from the combustion gases.

Furthermore, the various components of a conventional combustor must also typically withstand differential axial pressures thereon, and vibratory response without adversely affecting the useful life of the components. This provides additional problems in mounting non-metallic materials in the combustor since such mounting must also accommodate pressure loads and vibration of the components in addition to accommodating thermal expansion and contraction thereof.

SUMMARY OF THE INVENTION

A mounting assembly includes an annular supporting flange disposed coaxially about a centerline axis which has a plurality of circumferentially spaced apart supporting holes therethrough. An annular liner is disposed coaxially with the supporting flange and includes a plurality of circumferentially spaced apart mounting holes aligned with respective ones of the supporting holes. Each of a plurality of mounting pins includes a proximal end fixedly joined to the supporting flange through a respective one of the supporting holes, and a distal end disposed through a respective one of the liner mounting holes for supporting the liner to the supporting flange while allowing unrestrained differential thermal movement of the liner relative to the supporting flange.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
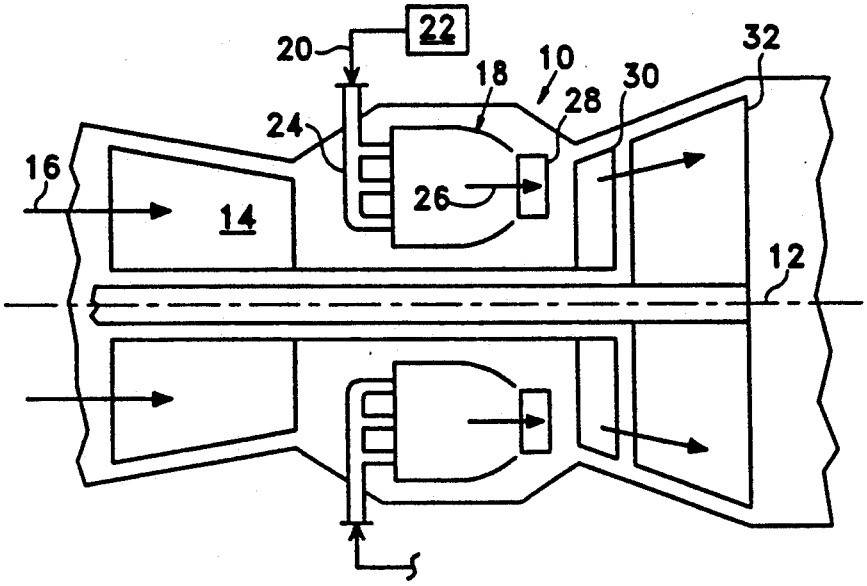
FIG. 1 is a schematic, longitudinal sectional view of a portion of a gas turbine engine including an annular combustor in accordance with one embodiment of the present invention.

Illustrated schematically in FIG. 1 is a portion of an exemplary gas turbine engine 10 having a longitudinal or axial centerline axis 12. The engine 10 is configured for powering a High Speed Civil Transport (HSCT) at high Mach numbers and at high altitude with reduced oxides of nitrogen ($NO_x$) in accordance with one objective of the present invention. The engine 10 includes, inter alia, a conventional compressor 14 which receives air 16 which is compressed therein and conventionally channeled to a combustor 18 effective for reducing $NO_x$ emissions. The combustor 18 is an annular structure disposed coaxially about the centerline axis 12 and is conventionally provided with fuel 20 from a conventional means 22 for supplying fuel which channels the fuel 20 to a plurality of circumferentially spaced apart fuel injectors 24 which inject the fuel 20 into the combustor 18 wherein it is mixed with the compressed air 16 and conventionally ignited for generating combustion gases 26 which are discharged axially downstream from the combustor 18 into a conventional high pressure turbine nozzle 28, and, in turn, into a conventional high pressure turbine (HPT) 30. The HPT 30 is conventionally joined to the compressor 14 through a conventional shaft, with the HPT 30 extracting energy from the combustion gases 26 for powering the compressor 14. A conventional power or low pressure turbine (LPT) 32 is disposed axially downstream from the HPT 30 for receiving therefrom the combustion gases 26 from which additional energy is extracted for providing output power from the engine 10 in a conventionally known manner.

Figure 2:
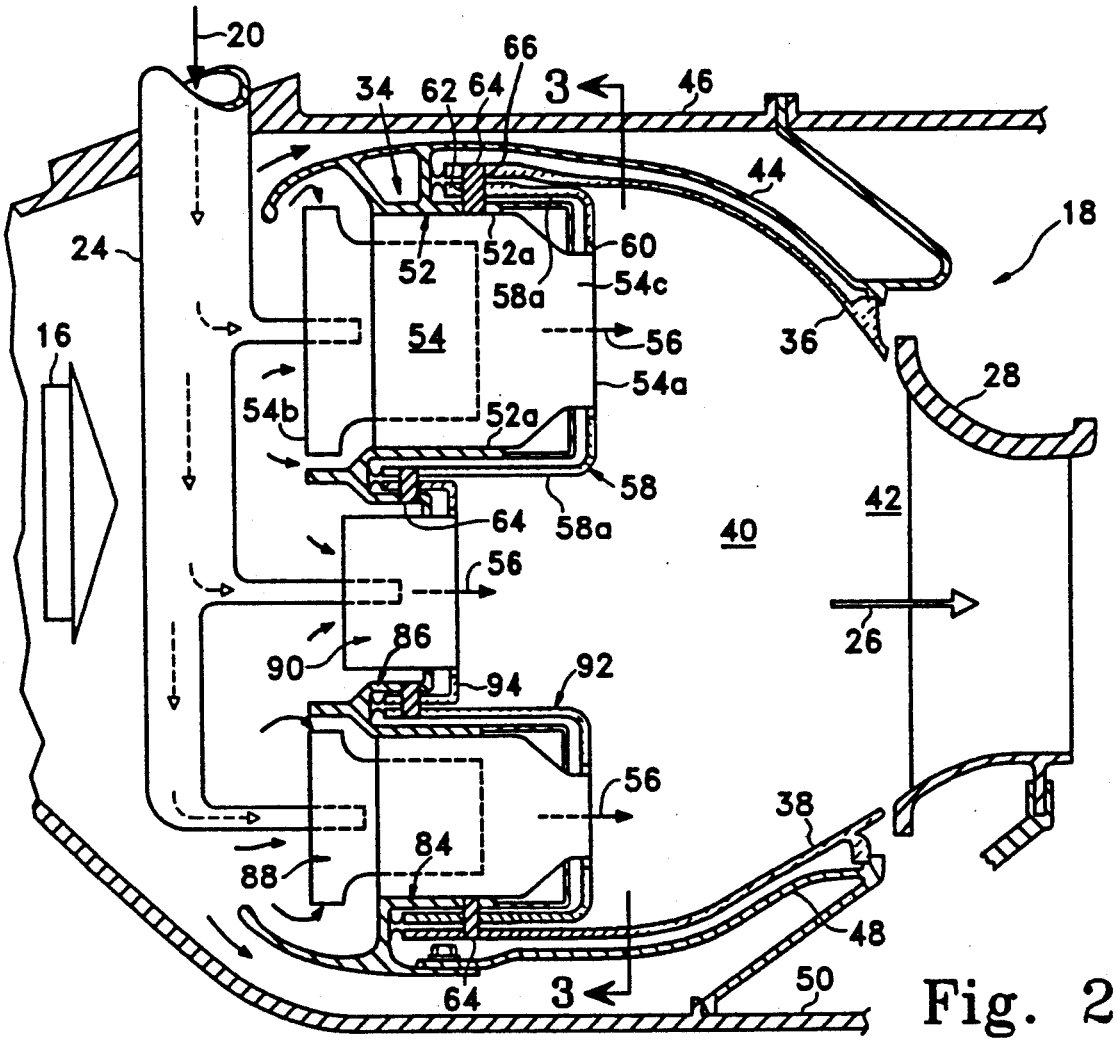
FIG. 2 is an enlarged schematic view of the top portion of the combustor shown in FIG. 1 illustrating an exemplary triple dome assembly including heat shields in accordance with one embodiment of the present invention.

Illustrated in more detail in FIG. 2 is the upper portion of the combustor 18 of FIG. 1 which includes at its upstream end an annular structural dome assembly 34 to which are joined an annular radially outer liner 36 and an annular radially inner liner 38. The inner liner 38 is spaced radially inwardly from the outer liner 36 to define therebetween an annular combustion zone 40, with downstream ends of the outer and inner liners 36, 38 defining therebetween a combustor outlet 42 for discharging the combustion gases 26 therefrom and into the nozzle 28. In the exemplary embodiment illustrated in FIG. 2, the dome assembly 34 includes a radially outer, annular supporting frame 44 conventionally joined to an annular outer casing 46, and a radially inner, annular supporting frame 48 conventionally fixedly joined to an annular, radially inner casing 50. The dome assembly 34 may be otherwise conventionally supported to the outer and inner casings 46, 50 as desired.

In the exemplary embodiment illustrated in FIG. 2, the dome assembly 34 and the outer and inner frames 44, 48 are made from conventional metallic combustor materials typically referred to as superalloys. Such superalloys have relatively high temperature capability to withstand the hot combustion gases 26 and the various pressure loads, including axial loads, which are carried thereby due to the high pressure air 16 from the compressor 14 acting on the dome assembly 34, and on the liners 36, 38.

In a conventional combustor, conventional metallic combustion liners would extend downstream from the dome assembly 34, with each liner including a plurality of conventional film cooling apertures therethrough which are supplied with a portion of the compressed air 16 for cooling the liners, with the spent film cooling air then being discharged into the combustion zone 40 wherein it mixes with the combustion gases 26 prior to discharge from the combustor outlet 42. An additional portion of the cooling air 16 is also conventionally used for cooling the dome assembly 34 itself, with the spent cooling air also being discharged into the combustion gases 26 prior to discharge from the outlet 42. Bleeding a portion of the compressed air 16 from the compressor 14 (see FIG. 1) for use in cooling the various components of a combustor necessarily reduces the available air which is mixed with the fuel 20 and undergoes combustion in the combustion zone 40 which, in turn, decreases the overall efficiency of the engine 10. Furthermore, any spent cooling air 16 which is reintroduced into the combustion zone 40 and mixes with the combustion gases 26 therein prior to discharge from the outlet 42 typically increases nitrogen oxide ($NO_x$) emissions from the combustor 18 as is conventionally known.

For the HSCT application described above, it is desirable to reduce the amount of the air 16 bled from the compressor 14 for cooling purposes, and to also reduce the amount of spent cooling air injected into the combustion gases 26 prior to discharge from the combustor outlet 42 for significantly reducing $NO_x$ emissions over a conventionally cooled combustor.

In accordance with one object of the present invention, the outer and inner liners 36, 38 are preferably non-metallic material effective for withstanding heat from the combustion gases 26 and are also preferably substantially imperforate and characterized by the absence of film cooling apertures therein for eliminating the injection of spent film cooling air into the combustion gases 26 prior to discharge from the outlet 42 for reducing $NO_x$ emissions and also allowing higher temperature combustion with the combustion zone 40. Conventional non-metallic combustor liner materials are known and include conventional Ceramic Matrix Composites (CMC) materials and carbon/carbon (C/C) as described above. These non-metallic materials have high temperature capability for use in a gas turbine engine combustor, but typically have low ductility and, therefore, require suitable support in the combustor 18 for accommodating pressure loads, vibratory response, and differential thermal expansion and contraction relative to the metallic dome assembly 34 for reducing stresses therein and for obtaining a useful effective life thereof.

Since conventional non-metallic combustor materials have a coefficient of thermal expansion which is substantially less than the coefficient of thermal expansion of metallic combustor materials such as those forming the dome assembly 34, the liners 36, 38 must be suitably joined to the dome assembly 34, for example, for allowing unrestricted or unrestrained thermal expansion and contraction movement relative to the dome assembly 34 to prevent or reduce thermally induced loads therefrom.

Furthermore, the metallic dome assembly 34 itself must also be suitably protected from the increased high temperature combustion gases 26 within the combustion zone 40 which are realizable due to the use of the non-metallic liners 36, 38.

In accordance with one embodiment of the present invention illustrated in FIG. 2, the dome assembly 34 includes at least one or a first annular dome 52 having a pair of axially extending and radially spaced apart first flanges 52*a* between which are suitably fixedly joined to the first dome 52 a plurality of circumferentially spaced apart first carburetors 54 which are effective for discharging from respective first outlets 54*a* thereof a fuel/air mixture 56. In the preferred embodiment illustrated in FIG. 2, the dome assembly 34 is a triple dome assembly as described in further detail hereinbelow but may include one or more domes in accordance with the present invention.

Figure 3:
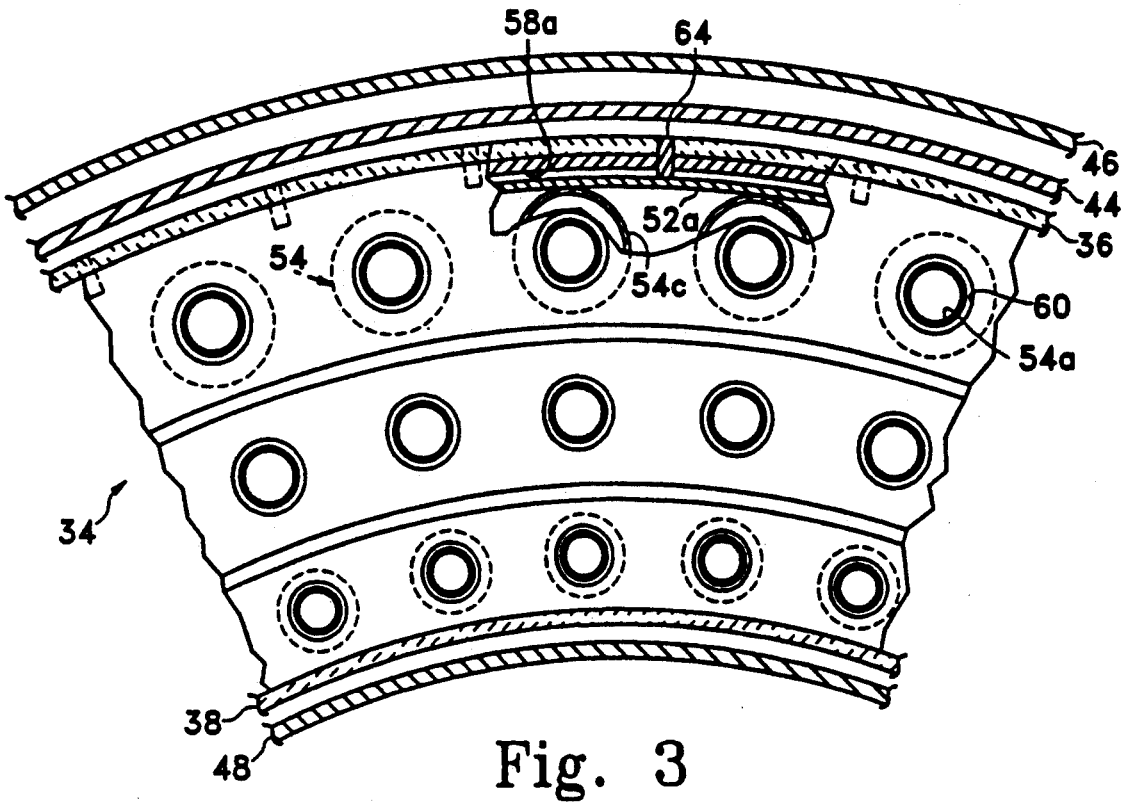
FIG. 3 is an upstream facing, partly sectional view of the combustor illustrated in FIG. 2 taken generally along line 3—3.

Each of the first carburetors 54 includes a conventional air swirler 54*b* which receives a portion of the fuel 20 from a first tip of the fuel injector 24 for mixing with a portion of the compressed air 16 and discharged through a tubular mixing can or mixer 54*c*, with the resulting fuel/air mixture 56 being discharged from the first outlet 54*a* into the combustion zone 40 wherein it is conventionally ignited for generating the combustion gases 26. Referring also to FIG. 3, several of the circumferentially spaced apart first carburetors 54 including their outlets 54*a* are illustrated in more particularity.

Figure 4:
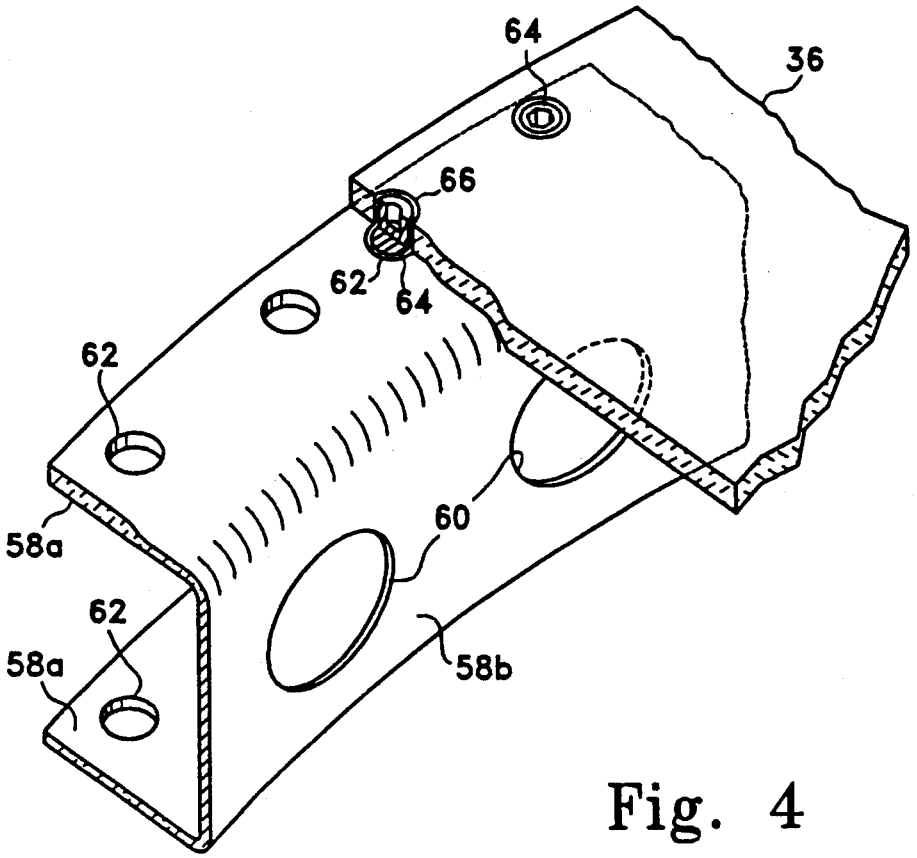
FIG. 4 is a perspective view of a portion of an exemplary one of the heat shields and liner used in the combustor illustrated in FIG. 2.

In order to protect the metallic first dome 52 and the first carburetors 54 from the high temperature combustion gases 26, an annular first heat shield 58 mounted in accordance with the present invention is provided and includes a pair of radially spaced apart and axially extending first legs 58*a*, better shown in FIG. 4, which are integrally joined to a radially extending first base or face 58*b* in a generally U-shaped configuration, with the first face 58*b* facing in a downstream, aft direction toward the combustion zone 40. The first face 58*b* includes a plurality of circumferentially spaced apart access ports 60 disposed concentrically with respective ones of the first outlets 54*a* for allowing the fuel/air mixture 56 to be discharged from the first carburetors 54 axially through the first heat shield 58. And, at least one, and preferably both, of the first legs 58*a* includes a plurality of circumferentially spaced apart and radially extending first mounting holes 62, as best shown in FIG. 4, disposed adjacent to a respective mounting one, and in a preferred embodiment both, of the first flanges 52*a*.

As shown in FIG. 2, the top leg 58*a* is disposed radially above the top first flange 52*a* and predeterminedly spaced therefrom, and the bottom leg 58*a* is disposed radially below the bottom first flange 52*a* and suitably spaced therefrom. In order to mount the first heat shield 58 to the dome assembly 34, a plurality of circumferentially spaced apart mounting pins 64 are fixedly joined to at least one of the first flanges 52*a* and extend radially through respective ones of the mounting holes 62 without interference or restraint therewith for allowing unrestrained differential thermal growth and contraction movement between the first heat shield 58 and the first dome 52 while supporting the first heat shield 58 against axial pressure loads thereon.

The outer diameter of the mounting pin 64 is suitably less than the inner diameter of the mounting hole 62, subject to conventional manufacturing tolerances, for allowing free radial movement of the mounting pin 64 through the mounting hole 62 subject solely to any friction therebetween where one or more portions of the mounting pin 64 slide against the mounting hole 62. As best shown in FIG. 2, the first dome 52 is, therefore, allowed to expand radially outwardly at a greater growth than the radially outwardly expansion of the annular first heat shield 58, with the mounting pins 64 sliding radially outwardly through the respective mounting holes 62. In this way, differential thermal movement between the first heat shield 58 and the first dome 52 is accommodated for preventing undesirable thermal stresses in the first heat shield 58 which could lead to its thermal distortion and damage thereof. However, the mounting pin 64 nevertheless supports the first heat shield 58 to the first dome 52 against pressure forces acting on the first heat shield 58 as well as vibratory movement thereof. For example, axial pressure forces across the first face 58*b* are reacted at least in part through the mounting pins 64 and transferred into the first dome 52 and in turn into the outer and inner frames 44, 48.

Since the first heat shield 58 is also preferably a non-metallic material formed, for example, from a ceramic matrix composite, it is preferably imperforate between the mounting holes 62 and the ports 60 as best shown in FIG. 4. Accordingly, no film cooling holes are provided in the first heat shield 58 and, therefore, no spent film cooling air is injected into the combustion gases 26 which would lead to an increase in $NO_x$ emissions. However, a portion of the compressed air 16 may be suitably channeled through a suitable baffle against the back sides of the outer and inner liners 36, 38 as well as against the back side of the first heat shield 58 for providing cooling thereof, and then suitably reintroduced into the flowpath without increasing $NO_x$ emissions.

Figure 5:
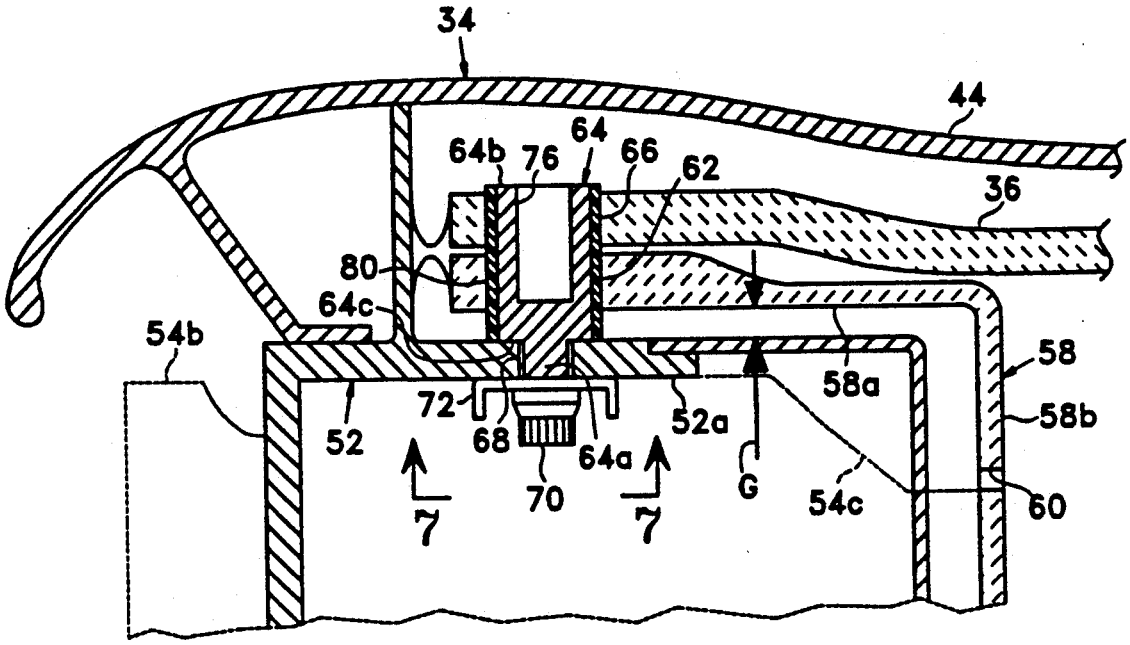
FIG. 5 is an enlarged partly sectional view of a heat shield and liner mounting assembly in accordance with one embodiment of the present invention.

FIG. 5 illustrates in more particularity the mounting of both the outer liner 36 through second mounting holes 66 at its upstream end, and the mounting of the first heat shield 58 to the dome assembly 34 using common mounting pins 64 in accordance with one embodiment of the present invention. More specifically, the first mounting holes 62 are disposed in at least one, and preferably both of the heat shield legs 58*a*, with the upper leg illustrated in FIG. 5, for example, being predeterminedly spaced radially outwardly from the supporting flange 52*a* to define a predetermined radial gap G therebetween. The pins 64 extend through the first mounting holes 62 and are fixedly joined to the supporting flange 52a through respective ones of a plurality of circumferentially spaced apart supporting holes 68 extending radially through the supporting flange 52a.

Figure 6:
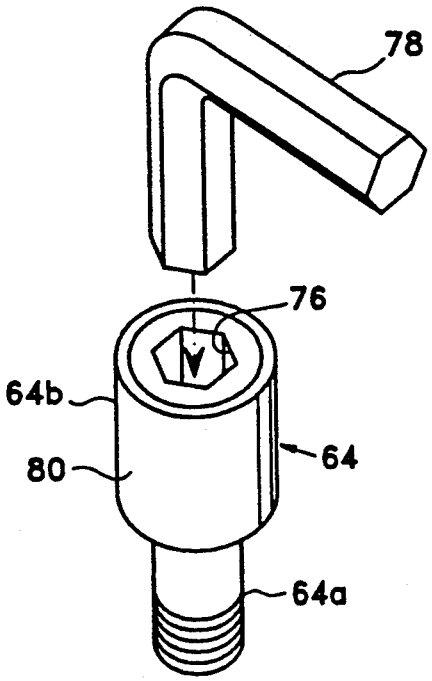
FIG. 6 is an exploded, perspective view of one of the mounting pins illustrated in FIG. 5 and a wrenching tool for tightening the pin into its mating nut.

Each mounting pin 64 includes a threaded proximal end 64a, as best seen in FIG. 6, removably fixedly joined to the supporting flange 52a through a respective one of the supporting holes 68, and a distal end 64b radially slidably disposed through a respective one of the mounting holes 62 for supporting the heat shield 58 to the supporting flange 52a while allowing unrestrained differential thermal expansion and contraction growth movement of the heat shield 58 relative to the supporting flange 52a. As shown in FIG. 5, the upper leg 58a of the heat shield 58 is predeterminedly spaced from the top of the supporting flange 52a at the supporting hole 68 for allowing the supporting flange 52a to thermally expand radially greater than the radial thermal expansion of the heat shield 58 at the mounting hole 62 without contacting the top leg 58a of the heat shield 58, i.e. the radial gap G remains always at some finite value greater than zero.

In the preferred embodiment, the dome assembly 34, including the supporting flanges 52a, is formed of conventional metals for use in a gas turbine engine combustor environment, and the heat shield 58 is preferably a non-metallic material such as the ceramic matrix composite material described above. Accordingly, the heat shield 58 has a coefficient of thermal expansion which is substantially less than the coefficient of thermal expansion of the supporting flange 52a which means that during operation in the gas turbine engine 10, the temperature of the combustion gases 26 will cause the annular supporting flange 52a to expand radially outwardly greater than the radially outward expansion of the annular heat shield 58 at its upper leg 58a, for example. The predetermined radial gap G between the supporting flange 52a and the heat shield leg 58a ensures that radial thermal expansion of the supporting flange 52a will not cause the flange 52a to contact the heat shield leg 58a and impose additional loads thereon. However, the resulting differential radial thermal movement between the supporting flange 52a and the heat shield leg 58a is accommodated by the mounting pins 64 which are free to slide without restraint through the heat shield mounting holes 62.

Accordingly, the several mounting pins 64 which are spaced generally uniformly around the centerline axis 12 provide axial, radial, and tangential support for the heat shield 58, while at the same time being free to translate radially outwardly relative to the centerline axis 12 for accommodating the differential thermal movement between the heat shield 58 and the supporting flange 52a.

Since a considerable number of the mounting pins 64 are provided around the circumference of the heat shield 58 to support the heat shield 58 to the dome assembly 34, typical manufacturing tolerances will affect the final location of not only the mounting pins 64 on the supporting flange 52a, but also the final positions of the respective mounting holes 62 within the heat shield 58 itself. In the preferred embodiment, it is desirable that each of the mounting pins 64 is accurately positioned or centered within each of its mating mounting holes 62 to ensure the uniform transfer of loads from the heat shield 58 through the respective pins 64 and to the supporting flange 52a. For example, during operation differential pressure loads act cross the heat shield face 58a in the downstream direction and must be reacted through the mounting pins 64 into the dome assembly 34. If all of the mounting pins 64 do not uniformly contact their respective mounting holes 62, the pressure loads transferred from the heat shield leg 58a to the mounting pins 64 will vary, with some pins 64 carrying more loads than other pins 64.

Accordingly, in order to more uniformly carry loads from the heat shield 58 through the mounting pin 64 to the supporting flange 52a, the threaded proximal end 64a of the pins 64 have smaller diameters than the respective diameters of the supporting holes 68 to provide a predetermined radial clearance extending circumferentially around the proximal end 64a as shown in FIG. 5. In this way, the proximal end 64a may be selectively adjustable within the supporting hole 68 during the assembly process for aligning the distal end 64b within its complementary mounting hole 62 in the heat shield leg 58a.

Figure 7:
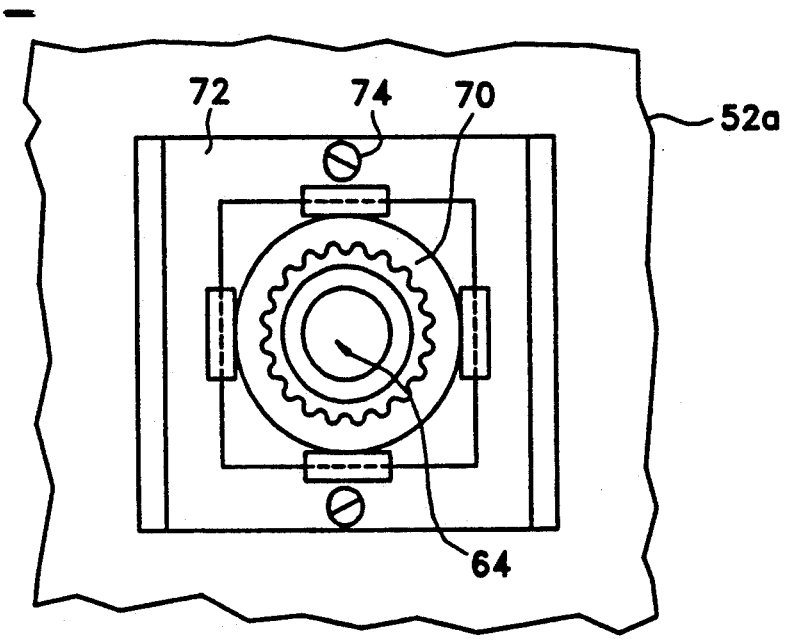
FIG. 7 is a radially outwardly facing view of the mounting nut illustrated in FIG. 5 and taken along line 7—7.

Also in the preferred embodiment as illustrated in FIGS. 5 and 7, a plurality of conventional floating captive nuts 70 are conventionally fixedly joined to the bottom of the supporting flange 52a below respective ones of the supporting holes 68 for threadingly receiving respective ones of the mounting pin proximal ends 64a during assembly. The nuts 70 are conventionally loosely supported in a capture plate 72 which in turn is fixedly joined to the supporting flange 52a by conventional rivets 74, for example. In this way, the plate 72 is fixedly joined to the supporting flange 52a and in turn loosely supports the nut 70 to allow for predetermined lateral movement thereof relative to the supporting holes 68. The mounting pins 64 may then be assembled to the nut 70 and tightened thereto in threading engagement therewith.

More specifically, in the preferred embodiment illustrated in FIGS. 5 and 6, for example, the mounting pin 64 is cylindrical, with the distal end 64b having a greater outer diameter than that of the proximal end 64a, and the distal end 64b includes a central wrenching recess 76 for receiving a complementary wrenching tool 78 as shown schematically in FIG. 6. In the exemplary embodiment illustrated, the wrenching recess 76 and tool 78 have complementary hexagonal configurations so that the wrenching tool 78 may be used for rotating the pins 64 for tightening the threaded proximal end 64a into a respective one of the nuts 70 to clamp the distal end 64b against the top of the supporting flange 52a. As shown in FIG. 5, the smaller diameter of the proximal end 64a relative to the distal end 64b creates a substantially flat and annular lower surface 64c at the junction of the proximal and distal ends 64a, 64b which rests against the top of the supporting flange 52a around the supporting holes 68.

In this way, when the pin 64 is tightened into its mating nut 70, the distal end 64b is compressed tightly against the supporting flange 52a for rigidly mounting the pins 64 thereto. However, prior to tightening of the mounting pins 64, the clearance between the proximal end 64a and the supporting hole 68 allows the pin 64 to be adjusted laterally, i.e. both in the axial and tangential directions, to ensure a more accurate positioning of all of the mounting pins 64 within their respective mounting holes 62 of the heat shield 58. Accordingly, the respective mounting pin distal ends 64b may be more accurately aligned around the circumference of the supporting flange 52a to ensure more uniform load transfer from the heat shield 58 through the pins 64 and into the supporting flange 52*a*. This will also ensure that a more predictable dynamic or vibratory response of the heat shield 58 may be obtained. Furthermore, since the pin distal ends 64*b* have a greater diameter than their respective proximal ends 64*a*, the larger diameter thereof reduces the per area unit loads from the heat shield 58 to the pins 64 which improves the useful life of the heat shields 58.

To further reduce the loads between the heat shield 58 and the pins 64, each of the pins 64, which is a suitable metal, preferably further includes a conventional compliant layer or coating 80 fixedly joined or bonded around the outer surface of the pin distal ends 64*b*. A suitable coating 80 is identified by the Bronsbond trademark of Brunswick Technics, and may be conventionally sprayed over the outer surface of the pin distal end 64*b* during manufacture, and then machined to the required outer diameter for the pin 64. The compliant coating 80 is preferably provided to further reduce the effects of surface rubs between the pins 64 and the holes 62 for reducing the possibility of damage to the heat shield 58 and improving its useful life.

The mounting pins 64 may be used not only for mounting the heat shields 58 to the dome assembly 34, but also for mounting the outer and inner liners 36, 38 thereto if desired. For example, FIG. 5 illustrates the upstream end of the outer liner 36 with the additional second mounting holes 66 being radially aligned with respective ones of the first mounting holes 62 of the heat shields 58, with the common mounting pins 64 having a suitable length for extending radially through both mounting holes 62 and 66. In this way, both the upstream ends of the outer liner 36 and the top leg 58*a* of the heat shield 58 are mounted to the first dome 52 at the top supporting flange 52*a* using common mounting pins 64. Since in the preferred embodiment, both the outer liner 36 and the heat shield 58 are preferably non-metallic, ceramic matrix composite materials, they both will expand and contract at the same rate, but at a lower rate than that of the metallic first dome 52. However, the mounting pins 64 are allowed to slide within the mounting holes 62, 66 during thermal expansion without imposing additional loads on the outer liner 35 and the heat shield 58 for improving the useful life thereof. The liners 36, 38, therefore, also enjoy the same benefits as those provided to the heat shield 58 when so mounted by the pins 64.

Figure 8:
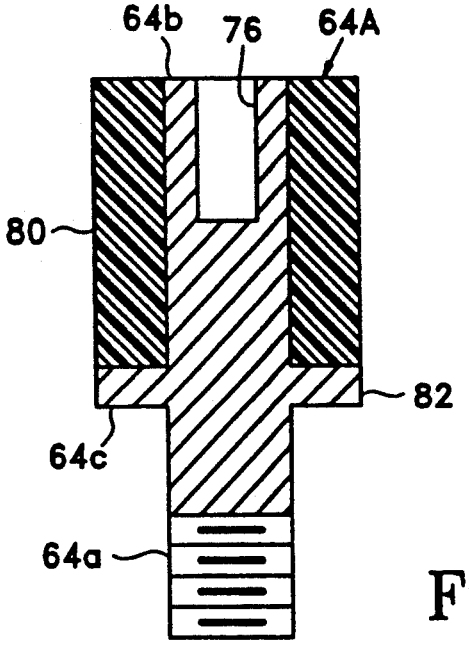
FIG. 8 is a sectional view of a mounting pin in accordance with a second embodiment of the present invention.

FIG. 8 illustrates an alternate embodiment of the mounting pin designated 64A being lighter weight for the same overall configuration. In this embodiment, the metallic pin distal end 64*b* has a smaller diameter equal to about the diameter of the proximal end 64*a*, and an enlarged, integral annular collar 82 is provided at the junction thereof and sized for accommodating the required compressive loads once the mounting pin 64A is tightened into its mating nut 70. The compliant coating 80 may therefore be thicker so that the outer diameter thereof matches that of the thinner coating 80 in the first mounting pin 64 illustrated in FIG. 5.

In alternate embodiments of the invention, similar mounting pin arrangements may be used for supporting a non-metallic liner type member subject to combustion gases in a gas turbine engine to a metallic supporting structure such as the annular flange 52*a*. For example, the triple dome combustor 18 illustrated in FIG. 2 includes a second annular dome 84 disposed adjacent the inner liner 38, and a third annular dome 86 disposed radially between the first dome 52 and the second dome 84. Respective pluralities of second and third carburetors 88 and 90, respectively, are suitably mounted into the second and third domes 84, 86, with the third dome 86 being used as a pilot dome for initial ignition, and the first and second domes 52 and 84 being used as main domes for channeling respective fuel/air mixtures 56 into the combustion zone 40 wherein they are conventionally ignited using the pilot dome combustion gases for generating the combustion gases 26.

The second dome 84 similarly includes an annular, generally U-shaped second heat shield 92, and the third dome 84 similarly includes an annular, generally U-shaped third heat shield 94. The three heat shields 58, 92, and 94 provide upstream boundaries to the combustion gases 26, with the outer and inner liners 36, 38 providing radial boundaries thereto. As shown schematically in FIG. 2, the two additional heat shields 92, 94 and the inner liner 38 may also be suitably joined to their respective domes by additional ones of the mounting pins 64. Also as shown in FIG. 2, the mounting pins 64 are joined to suitable flanges within the respective domes for mounting both the upper and lower legs of the respective heat shields to the respective domes. And, the lower leg of the first heat shield 58 is commonly joined with the upper leg of the third heat shield 94 by common mounting pins 64 to the third dome 86. And, similarly, the lower leg of the third heat shield 94 and the upper leg of the second heat shield 92 are commonly joined through respective mounting pins 64 also to the third dome 86.

Of course, the mounting assembly described above including the radially extending mounting pins 64 may be used wherever appropriate in a gas turbine engine environment for mounting a liner-type annular structure subject to combustion gases to an annular supporting flange for allowing unrestrained differential thermal expansion and contraction therebetween. Although the invention has been described with respect to an exemplary triple-dome combustor, it may be used in other types of combustors or in exhaust nozzles if desired.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is claimed and desired to be secured by Letters Patent of the United States is the invention as defined and differentiated in the following claims:

1. A mounting assembly subject to combustion gases in a gas turbine engine comprising:

an annular supporting flange disposed coaxially about a centerline axis, and including a plurality of circumferentially spaced apart supporting holes extending radially therethrough;

an annular liner for bounding said combustion gases at least in part and disposed coaxially with said supporting flange, said liner having a plurality of circumferentially spaced apart mounting holes radially aligned with respective ones of said supporting holes; and a plurality of mounting pins, each having a proximal end fixedly joined to said supporting flange through a respective one of said supporting holes, and a distal end radially slidably disposed through a respective one of said mounting holes for mounting said liner to said supporting flange while allowing unrestrained differential thermal movement of said liner relative to said supporting flange.

2. An assembly according to claim 1 wherein said liner is predeterminedly spaced from said supporting flange at each of said supporting holes for allowing said supporting flange to thermally expand radially greater than radial thermal expansion of said liner without contacting said liner.

3. An assembly according to claim 2 wherein each of said mounting pins is cylindrical, with said distal end having a greater diameter than said proximal end; and said proximal end has a smaller diameter than each of said supporting hole to provide a predetermined clearance therearound, with said proximal end being selectively adjustable with each of said supporting holes for aligning said distal end within said mounting holes.

4. An assembly according to claim 3 further including a plurality of floating captive nuts fixedly joined to said supporting flange below respective ones of said supporting holes, and threadingly receiving a respective one of said mounting pin proximal ends.

5. An assembly according to claim 4 wherein said mounting pin distal end includes a central wrenching recess for receiving a complementary wrenching tool for threadingly tightening said proximal end into a respective one of said nuts to clamp said distal end against said supporting flange.

6. An assembly according to claim 4 wherein each of said mounting pins further includes a compliant coating fixedly joined around said distal end thereof.

7. An assembly according to claim 4 wherein said liner has a coefficient of thermal expansion less than a coefficient of thermal expansion of said supporting flange.

8. An assembly according to claim 7 wherein:

said supporting flange is a portion of a combustor dome;

said liner is configured in the form of an annular heat shield having a generally U-shaped transverse configuration with a pair of axially extending legs integrally joined to a radially extending face; and said mounting holes are disposed in at least one of said legs, with said one leg being spaced radially outwardly from said supporting flange.

9. An assembly according to claim 8 further including a second one of said liners configured in the form of a combustor liner having a plurality of additional ones of said mounting holes aligned with said mounting holes of said heat shield, with said mounting pins extending radially through said mounting holes of both said heat shield and said combustor liner for mounting said heat shield and said combustor liner to said dome.

10. An assembly according to claim 9 wherein said heat shield and said combustor liner are non-metallic.

* * * * *